United States Patent [19]

Snyder

[11] 4,024,837

[45] May 24, 1977

[54] MULTIPLE STRATUM MASK

[76] Inventor: George Snyder, 120 Braintree St., Allston, Mass. 02134

[22] Filed: Dec. 3, 1975

[21] Appl. No.: 637,294

[52] U.S. Cl. ..... 118/505; 101/128.1; 427/282; 428/40

[51] Int. Cl.[2] ..... B05C 11/00; B05C 17/06; B41N 1/24

[58] Field of Search ..... 118/505, 504, 48–49.5; 427/282; 428/40; 101/128.2

[56] References Cited

UNITED STATES PATENTS

| | | | |
|---|---|---|---|
| 2,664,818 | 1/1954 | Heasley | 427/282 X |
| 2,688,918 | 9/1954 | Aaron | 101/128.2 X |
| 2,851,805 | 9/1958 | Allen | 118/504 X |
| 3,526,064 | 9/1970 | Spidell, Jr. | 101/128.2 X |
| 3,752,304 | 8/1973 | Alef | 118/505 X |
| 3,929,068 | 12/1975 | Budden | 101/128.2 |

*Primary Examiner*—James Kee Chi

*Attorney, Agent, or Firm*—Morse, Altman, Oates & Bello

[57] ABSTRACT

A mask for painting designs on a surface includes a lower stratum constituting a multi-piece stencil and an upper stratum superimposed on the lower stratum for maintaining the stencil pieces in fixed relationship. The lower stratum has a pressure sensitive adhesive on a bottom surface for holding the mask to the surface to be painted. The upper stratum has a pressure sensitive adhesive on a bottom surface which lightly sticks to a release coating on the upper surface of the lower stratum. After the mask is applied to the surface to be painted with the lower stratum adhering thereto, the upper stratum is peeled to expose the multipiece stencil.

11 Claims, 4 Drawing Figures

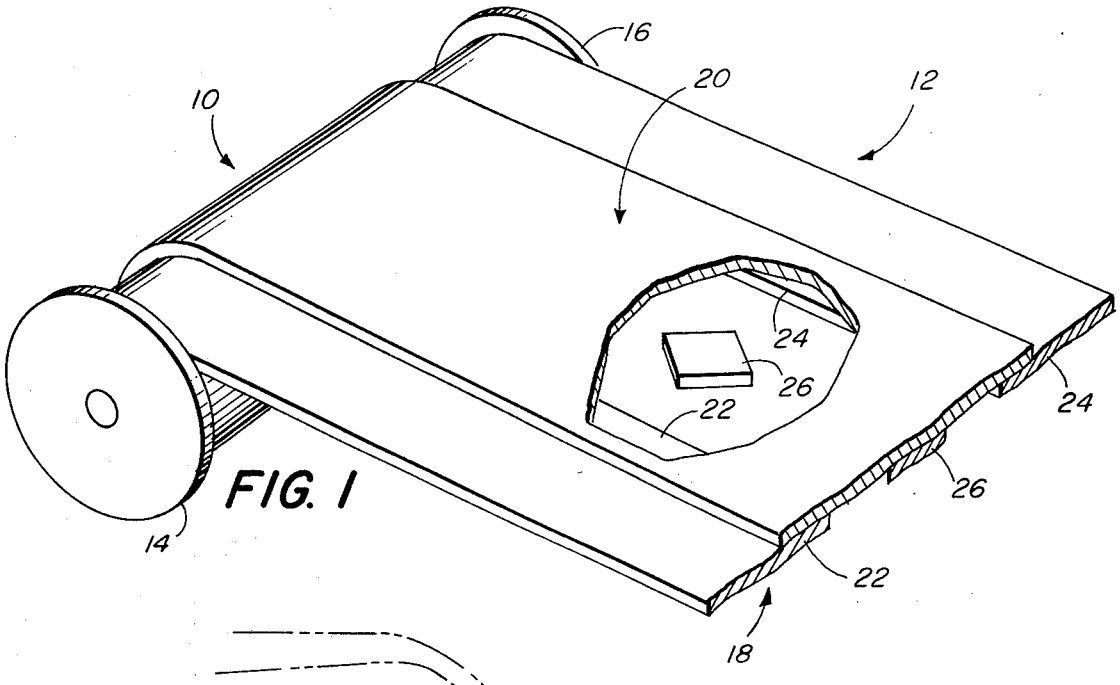
FIG. 1
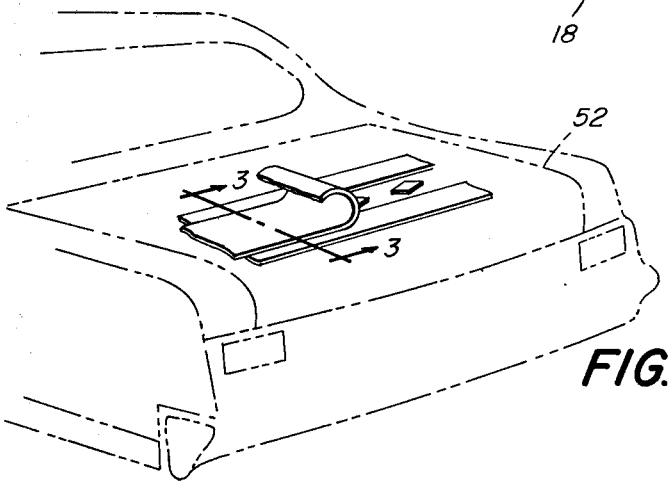
FIG. 2
FIG. 3
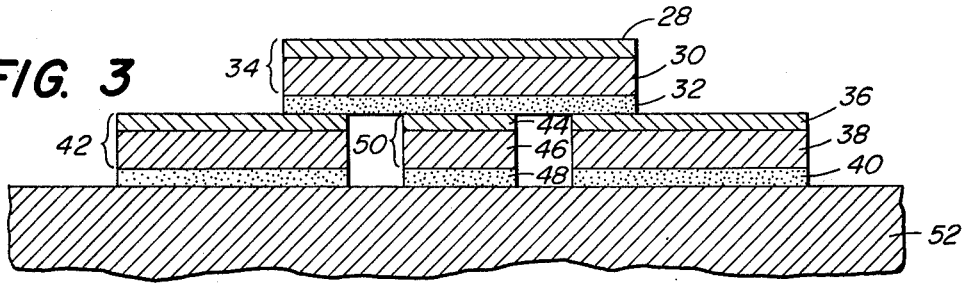
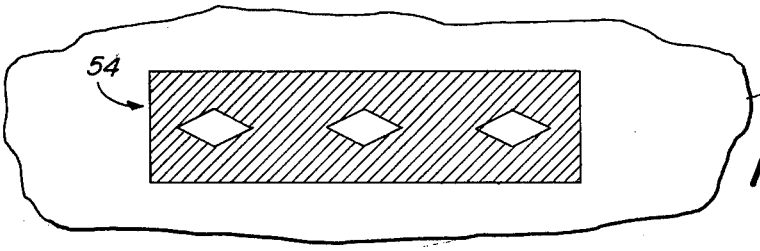
FIG. 4

MULTIPLE STRATUM MASK

BACKGROUND OF THE INVENTION

1. FIELD OF THE INVENTION

The present invention relates to masking devices and, more particularly, is directed towards a multiple stratum mask.

2. DESCRIPTION OF THE PRIOR ART

Generally, straight lines and other ornamental designs are painted on automobile bodies by carefully placing masking tape about the area to be painted. In the case of a straight line, two strips of masking tape are placed side-by-side, great care being taken to ensure that the edges of the tape are parallel to one another. After the masking tape is in positon, the area between the strips is spray painted. Generally, the time required to accurately locate the masking tape is greater than the painting time. A need has arisen for a mask that can be expeditiously applied to an automobile surface for painting signs thereon without the time consuming task of precisely aligning several strips of masking tape.

SUMMARY OF THE INVENTION

It is an object of the present invention to provide a masking devie which does not suffer from the heretofore mentioned disadvantages. The masking device constitutes a multi-stratum mask roll having an endless lower stratum in the form of a multi-piece stencil and an endlss upper stratum for maintaning the stencil pieces in a fixed relationship. The lower stratum includes a pair of endless strips that are disposed in parallel relationship to one another and a plurality of shaped segments that are positioned between the strips. Each endless strip and each shaped piece includes a release coating upper surface, an intermediate layer of a paint impervious material and a pressure sensitive adhesive lower surface. The upper stratum, which is superimposed on the lower stratum, has a pressure sensitive adhesive on a bottom surface and a release coating on an upper surface. The tack of the pressure sensitive adhesive of the upper stratum is more aggresive with respect to the release coating of the lower stratum than the tack of the pressure sensitive adhesive of the lower stratum with respect to the release coating of the upper stratum. The masking device is used by unwrapping and cutting off a desired length of the multi-stratum mask from the roll. The severed piece of mask is presssed on a surface to be painted, the pressure sensitive adhesive surface of the peeled to expose the multi-piece stencil, the tack of the lower stratum pressure sensitive adhesive with respect to the surface to be painted being more aggressive than the tack of the upper stratum pressure sensitive adhesive with respect to the lower stratum release coat. The open areas of the multi-piece stencil are painted. After the paint has dried, the strips and segments are removed to expose an ornamental design.

Other objects of the present invention will in part be obvious and will in part appear hereinafter.

The invention accordingly comprises the apparatuses, processes and products, together with their parts, steps, elements and inter-relationships, that are exemplified in the following disclosure, the scope of which will be indicated in the appended claims.

BRIEF DESCRIPTION OF THE DRAWINGS

A fuller understanding of the nature and objects of the present invention will become apparent upon consideration of the following detailed description taken in connection with the accompanying drawings, wherein:

FIG. 1 is a perspective view of a roll of a multi-stratum mask embodying the present invention;

FIG. 2 is a perspective view of a section of the multi-stratum mask of FIG. 1 applied to an automobile body;

FIG. 3 is a sectional view taken along the lines 3-3 of FIG. 2; and

FIG. 4 is a plan view of a design painted on the automobile using the multi-stratum mask of FIG. 1.

DETAILED DESCRIPTION OF THE PREFERRED EMBODIMENTS

Referring now to the drawings, particularly FIG. 1, there is shown an endless roll 10 of a multi-stratum mask 12 which is disposed between a pair of end plates 14, 16. Multi-stratum 12 comprises a lower stratum 18 and a superimposed upper stratum 20. Lower stratum 18 includes a pair of endless strips 22, 24 and shaped segments 26, the strips and segments constituting a multi-piece stencil.The inner ddges of strips 22 and 24 are in parallel relationship and segments 26 are spaced between the strips along a longitudnal axis of lower stratum 18, the strips and segments being coplanar. The width of each strip 22 and 24 is in the approximate range of 1.0 cm to 10.0 cm and preferably 2.5 cm. The distance between the inner edges of strips is in the approximate range of 0.5 cm to 5.0 cm. In the illustrated embodiment, by way of example, segments 26 have a diamond profile. In alternative embodiments, segments 26 have other than diamond profiles, for example, circular square, rectangular or some other profile.The length of each diamond 26 along the longitudinal axis of lower stratum 18 is in the approximate range of 0.5 cm to 3.0 cm and preferably 2.0 cm. The spacing between each diamond 26 is in the approximate range of 1.0 cm to 5.0 cm. Preferably, diamonds 26 are centered between the inner edges of strips 22 and 24 and spaced therefrom approximately 0.1 cm to 1.0 cm. The width of upper stratum 20 is in the approximate range of 1.0 cm to 10.0 cm. Upper stratum 20 is centered along the longitudnal axis of lower stratum 18 and overlaps strips 22 and 24. As hereinafter described, strips 22, 24 and segments 26 are maintained in a fixed relationship to one another by upper stratum 20.

Referring now to FIG. 3, it will be seen that superimposed upper stratum 20 includes an upper layer 28 having a release coating, an intermediate layer 30 and a pressure sensitive adhesive bottom layer 32. Intermediate layer 30 is composed of a material such as paper or a plastic that is impervious to an organic vehicle used in paints, for example linseed oil and water. In one embodiment, upper layer and intermediate layer 30 is a silicone impreganted paper release strarum 34 that is approximately 50 microns thick. Pressure sensitive adhesive layer 32 is composed of an acrylic base resin and an elastomeric polyene tackifier, and ranges in thickness from 10 microns to 30 microns. A typical formulation of pressure sensitive layer 32 incorporates from 15 to 30 parts of a straight chain acrylate, particularly, a copolymer, homopolymer or interpolymer of methyl acrylate, ethyl acrylate, propyl acrylate or butyl acrylate, and from 2.5 to 7.5 parts of a low molecular weight rubber, particularly, a polyhydrocaron such as polybutene or polyterpene. In the illustrated embodiment, pressure sensitive layer 32 is a layer of a methyl acrylate polybutene pressure sensitive adhesive.

Each strip 22 and 24 includes an upper layer 36 having a release coating, an intermediate layer 38 and a pressure sensitive adhesive bottom layer 40. Intermediate layer 38 is composed of a material such as paper or a plastic that is impervious to an organic vehicle of the type used in paints, for example linseed oil that is used in oil base paints and an aqueous solution such as water that is used in latex paints. Collectively, in the illustrated embodiment, upper layer 36 and intermediate layer 38 is a silicone impregnated paper release stratum 42 that is approximately 50 microns thick. Pressure sensitive adhesive layer 40 is composed of a pressure sensitive adhesive of the type described in connection with pressure sensitive layer 32 and ranges in thickness from 10 microns to 30 microns.

Each segment 26 includes an upper layer 44 having a release coating, an intermediate layer 46 and a pressure sensitive buttom layer 48. Intermediate layer 46 is composed of a material such as paper or a plastic that is impervious to an organic vehicle used in paints, for example linseed oil used in oil base paints and an aqueous solution such as water used in latex paints. In the illustrated embodiment, upper layer 44 and intermediate layer 46 constitutes a silicone impregnated paper release stratum 50 that is approximately 50 microns thick. Pressure sensitive adhesive layer 48, the thickness of which is in the range of 10 microns to 30 microns, is composed of a pressure sensitive adhesive of the type described in connection with pressure sensitive adhesive layer 32.

The tack of pressure sensitive adhesive layer 32 is more agressive with respect to release coatings 36 and 40 than the tack of pressure sensitive adhesive layers 40 and 48 with respect to release coating 28. The relative aggressiveness of the tacks of the pressure sensitive adhesive layers of lower and; upper strata 18, 20 with respect to the release coatings of the strata are such that when multi-stratum mask 12 is unwound from roll 10, upper stratum 20 and lower stratum 18 remain in tact. That is, as multi-stratum mask 12 is unwound, pressure sensitive adhesive layers 40 and 48 of lower stratum 18 separate from release coating 28 of upper stratum 20 and pressure sensitive adhesive layer 32 of upper stratum 20 remains attached to release coatings 36 and 44 of lower stratum 18.

In use, a selected length of multi-stratum mask 12 is removed from roll 10 and pressed onto a surface 52 to be painted, for example an automobile body, pressure sensitive adhesive layers 40 and 48 adhering to the automobile. Next, upper stratum 20 is peeled to expose strips 22, 24, and segments 26. The tack of pressure sensitive adhesive layers 40, 48 is more agressive with respect to surface 52 that the tack of pressure sensitive adhesive layer 32 with respect to release coating 36. That is, upper stratum 20 is peeled relatively easily from lower stratum 18 without disturbing the relative positions of strips 22, 24 and segments 26. After upper stratum is peeled, the area between strips 22 and 24 is painted using either an oil base paint, a latex paint or an acrylic paint. It is to be noted that intermediate layers 38 and 46 are composed of a material that is impervious to the foregoing paints. In the illustrated embodiment, the areas between strips 22 and 24 is painted by spraying with an acrylic paint. After the paint has dried, strips 22, 24 and segments 26 are removed, leaving a design of the type shown in FIG. 4 at 54.

In an alternative embodiment, roll 10 comprises a multi-stratum mask having only strips 22 and 24.

Since certain changes may be made in the foregoing disclosure without departing from the scope of the invention herein involved, it is intended that all matter contained in the above description and depicted in the accompanying drawings be construed in an illustrative and not in a limiting sense.

What is claimed is:

1. A multi-stratum mask comprising:

a. a lower stratum having at least two endless composite strips spaced apart from one another, each said strip having superimposed layers formed by a release coating upper layer, a paint impervious intermediate layer and a pressure sensitive adhesive lower layer; and b. a composite upper stratum superimposed on said lower stratum and covering at least a portion of each said strip, said upper stratum having superimposed layers formed by a release upper coating, a paint impervious intermediate layer and a pressure sensitive lower layer, said upper stratum lower layer releasably adheres to said release coating of said lower stratum .

2. The multi-stratum mask as claimed in claim 1 wherein said endless strips are in spaced parallel relationship.

3. The multi-stratum mask as claimed in claim 2 wherein said lower stratum includes a plurality of spaced segments disposed between said strips, said segments and said strips being coplanar, said segments having superimposed layers formed by a release coating upper layer, a paint impervious intermediate layer and a pressure sensitive adhesive coating.

4. The multi-stratum mask as claimed in claim 3 wherein each of said release coating and intermediate layer of said lower stratum and said release coating and intermediate layer of said upper stratum is a silicon impregnated paper having a thickness of approximately 50 microns.

5. The multi-stratum mask as claimed in claim 1 wherein said pressure sensitive adhesive of said lower stratum has a first tack level and said pressure sensitive adhesive of said upper stratum has a second tack level, said second tack level being more aggressive with respect to said lower stratum release coating than said first tack level with respect to said upper stratum release coating.

6. A roll of multi-stratum mask for use in painting a design on a surface, said multi-stratum mask comprising:

a. a composite lower stratum having at least two endless strips spaced apart from one another;

b. each said strip having a release coating upper layer, an intermediate layer composed of a material that is impervious to paint, and a pressure sensitive adhesive bottom layer; and a composite upper stratum superimposed on said lower stratum and covering at least a portion of each said strip, said upper stratum having a pressure senstive adhesive lower layer, an intermediate layer composed of a material that is impervious to paint and a release coating upper stratum;

d. said pressure sensitive adhesive layer of said upper stratum has a more aggressive tack with respect to said release coating of said lower stratum than said pressure sensitive adhesive layers of said strips have with respect to said release coating of said upper stratum, whereby said pressure sensitive layers of said strips separated from said release coating of said upper stratum and said pressure sensitive layer of said upper stratum remains attached to said release coatings of said strips when said roll is unwound.

7. The multi-stratum mask as claimed in claim 6 wherein said lower stratum includes a plurality of spaced segments disposed between said strips, said strips and said segments coplanar, each said segment having a release coating upper layer, an intermediate layer composed of a material that is impervious to paint and a pressure sensitive adhesive bottom layer, said pressure sensitive adhesive layer of each said segment having a tack that corresponds to the tack of said pressure sensitive adhesive layer of said strips.

8.The multi-stratum mask as claimed in claim 7 wherein said pressure sensitive adhesive layers of said strips and said segments are composed of a tacky formulation of an acrylate and an elastomeric polyene.

9. The multi-stratum mask as claimed in claim 8 wherein said intermediate layer and said release coating layer of each said strip and each said segment is a siclicone impregnated paper that is approximately 50 microns thick.

10. The multi-stratum mask as claimed in claim 9 wherein said strips are parallel to one another and spaced equally from a longitudinal axis of said multi-stratum mask, each said segment having a diamond profile and disposed along the longitudinal axis of said multistratum mask, said upper stratum covering said segments and overlapping at least the inner margins of each said strip for holding said segments and said strips in fixed relationship to one another.

11. The multi-stratum mask as claimed in claim 7 wherein said pressure sensitive layers of said strips and semgents has a tack that is more aggressive with respect to said surface to be painted than the tack of said pressure sensitive adhesive layer of said upper stratum with respect to said release coating of said strips and segments

* * * * *